United States Patent [19]

Ingle, III et al.

[11] Patent Number: 5,052,360

[45] Date of Patent: Oct. 1, 1991

[54] PROCESS AND APPARATUS FOR TIMED PORT INJECTION OF FUEL TO FORM A STRATIFIED CHARGE

[75] Inventors: William D. Ingle, III; Allen D. Wells, both of Park Ridge, Ill.

[73] Assignee: Gas Research Institute, Chicago, Ill.

[21] Appl. No.: 454,397

[22] Filed: Dec. 21, 1989

[51] Int. Cl.[5] ..... F02B 17/00; F02B 7/08; F02B 43/04; F02M 21/04

[52] U.S. Cl. ..... 123/430; 123/431; 123/527

[58] Field of Search ..... 123/430, 431, 295, 304, 123/525, 527

[56] References Cited

U.S. PATENT DOCUMENTS

| | | | |
|---|---|---|---|
| 2,484,009 | 10/1949 | Barber | 123/430 |
| 3,068,086 | 12/1962 | Ensign et al. | 123/527 |
| 3,114,357 | 12/1963 | Mortin et al. | 123/527 |
| 3,140,701 | 7/1964 | Cooper et al. | 123/527 |
| 3,195,525 | 7/1965 | Beck | 123/73 A |
| 3,269,713 | 8/1966 | Beck | 261/41.5 |
| 3,877,229 | 4/1975 | Resler, Jr. | 60/597 |
| 3,924,598 | 12/1975 | Davis | 123/430 |
| 4,015,161 | 3/1977 | Resler, Jr. | 313/143 |
| 4,015,569 | 4/1977 | Leshner et al. | 123/430 |
| 4,104,989 | 8/1978 | Resler, Jr. | 123/430 |
| 4,105,008 | 8/1978 | Resler, Jr. | 123/568 |
| 4,105,009 | 8/1978 | Resler, Jr. | 123/193 H |
| 4,111,161 | 9/1978 | Ueno et al. | 123/527 |
| 4,132,209 | 1/1979 | Resler, Jr. | 123/169 R |
| 4,135,481 | 1/1979 | Resler, Jr. | 123/568 |
| 4,151,821 | 5/1979 | Wichman et al. | 123/527 |
| 4,308,843 | 1/1982 | Garretson | 123/527 |
| 4,395,992 | 8/1983 | Poehlman | 123/527 |
| 4,413,593 | 11/1983 | Resler, Jr. | 123/430 |
| 4,453,502 | 6/1984 | Resler, Jr. | 123/430 |
| 4,610,236 | 9/1986 | Okino | 123/585 |
| 4,610,267 | 4/1986 | Beck et al. | 137/596.17 |
| 4,628,881 | 12/1986 | Beck et al. | 123/447 |
| 4,641,625 | 2/1987 | Smith | 123/304 |
| 4,658,792 | 4/1987 | Yamashita et al. | 123/430 |
| 4,901,698 | 2/1990 | Novy | 123/525 |

FOREIGN PATENT DOCUMENTS

| | | | |
|---|---|---|---|
| 3248713 | 7/1984 | Fed. Rep. of Germany | 123/295 |
| 0030416 | 2/1985 | Japan | 123/431 |
| 0030417 | 2/1985 | Japan | 123/431 |
| 0030439 | 2/1985 | Japan | 123/431 |
| 0082241 | 4/1987 | Japan | 123/295 |

OTHER PUBLICATIONS

SAE Technical Paper Series 891652, "Electronic Fuel Injection for Dual Fuel Diesel Methane", N. J. Beck, W. P. Johnson, A. F. George, P. W. Petersen, B. Vanderlee and G. Klopp for Future Transportation Technology Conference, Vancouver, B.C., Canada, Aug. 7-10, 1989.

"Intake Valve Deposits: Engines, Fuels, and Additive Effects", R. C. Tupa and D. E. Koehler, Automotive Engineering, vol. 97, No. 1, Jan., 1989.

"Automotive Engine Alternatives", R. L. Evans, University of British Columbia, Vancouver, B.C., Canada, Plenum Press, 1987, no month.

*Primary Examiner*—Tony M. Argenbright
*Assistant Examiner*—Robert E. Mates
*Attorney, Agent, or Firm*—Thomas W. Speckman; Douglas H. Pauley

[57] ABSTRACT

A process and apparatus for timed port injection and enriched stratified charge of fuel, preferably gaseous fuel, into an internal combustion engine. The process begins with forming a lean fuel/air mixture with a first fuel portion in an intake manifold upstream of a port injector. The lean fuel/air mixture is uniformly distributed into a combustion chamber during an intake phase of an engine cycle. A subsequent fuel portion is injected in a controlled manner during the intake phase so as to form a stratified charge near the ignitor within the cylinder. The stratified charge within the cylinder is ignited and combusted. Combustion products are then exhausted from the combustion chamber. This invention also provides an apparatus and process for injecting a gaseous fuel within a combustion chamber to form an enriched portion of a stratified charge near the ignitor.

24 Claims, 2 Drawing Sheets

PROCESS AND APPARATUS FOR TIMED PORT INJECTION OF FUEL TO FORM A STRATIFIED CHARGE

BACKGROUND OF THE INVENTION

1. Field of the Invention

This invention relates to a process and apparatus for central metering of a first portion of fuel to form a lean fuel/air mixture and timed port injection of a remaining enriched portion of the fuel forming a stratified charge within a cylinder or combustion chamber of an internal combustion engine. This invention also relates to only timed port injection of a gaseous fuel forming a stratified charge within a cylinder or combustion chamber of an internal combustion engine.

2. Description of the Prior Art

Injection of liquid fuels into a manifold, a combustion chamber or cylinder of an internal combustion engine is familiar in the art. Existing designs also use a pre-chamber for inducing stratified charge in gaseous fueled engines. Timed port injection of gaseous fuels without forming a stratified charge is also known in the art. Injection of air or exhaust gas into an intake manifold to preform a stratified charge is known in the art.

A draft copy of "SAE Technical Paper Series, 891652, Electronic Fuel Injection for Dual Fuel Diesel Methane" by N. J. Beck, W. P. Johnson, A. F. George, P. W. Petersen, B. Vanderlee and G. Klopp for Future Transportation Technology Conference held in Vancouver, B.C., Canada, on Aug. 7-10, 1989, discloses types of possible systems which might be employed to meter and burn gaseous fuels. One of the types of possible systems discussed in such paper includes the following aspects: dual fuel, diesel pilot, mechanical pump and governor, multipoint, lean burn, timed gas pulse port injection, stratified charge, unthrottled, turbocharged and aftercooled. Such technical paper also discusses future plans for expanding use of the basic dual fuel retrofit kit for an OM-352 diesel engine. The referenced technical paper states that future research efforts will relate to a technique for accomplishing very lean burn with accompanying reduction in nitrogen oxides. Thus, a need exists for a system that uses fast-timed pulse injection of gas to generate a stratified charge.

"Intake Valve Deposits: Engines, Fuels, and Additive Effects", R. C. Tupa and D. E. Koehler, Automotive Engineering, Volume 97, No. 1, January, 1989, discusses excessive build-up of intake valve deposits due to multiport, liquid fueled, lean-burn engine designs. Such technical paper states that significant losses in fuel economy, increased emission and reduction in peak power result from heavy intake valve deposits. The technical paper also states that build-up of intake valve deposits is common, particularly with fast-burn/lean-burn engines.

U.S. Pat. Nos. 4,104,989 and 4,135,481 disclose preforming a predetermined portion of a stratified charge composed of a fuel/air mixture diluted by exhaust gas, within an intake manifold when an intake valve for a cylinder is in a closed condition. A remaining portion of the stratified charge is subsequently introduced with the predetermined portion of the stratified charge when the intake valve is opened, during the intake stroke of the engine. The '481 patent discloses diluting the predetermined portion of the stratified charge within the intake manifold with a pocket or curtain of recirculated exhaust gas. Both patents teach use of an additional air source or plural air sources to precharge a fuel/air mixture in a portion of the intake manifold, uniquely associated with a closed intake valve, with a structured fuel/air ratio layer. A predetermined quantity of pre-stratifying air is introduced into a portion of the intake manifold which is adjacent the intake valve. A replaceable orifice passage having a predetermined size is selected to "tune" the intake manifold portion. An air throttle valve is used to control the amount of air introduced into the intake manifold to control total mixture flow and power. When the intake valve is opened, the resultant pre-stratified air or lean mixture is initially introduced into the cylinder. The space adjacent the spark plug is filled with a fuel/air mixture supplied by a carburetor. Upon opening the intake valve, the initial quantity of air is drawn into the cylinder during the intake stroke to form a layer of air adjacent the piston. The '989 patent further discloses that upon opening of the intake valve during the intake stroke, the stratified charge created with the aid of auxiliary air intake devices is delivered to the cylinder forming: (1) a relatively rich fuel/air mixture layer adjacent the face of the piston, (2) a middle relatively lean fuel/air mixture layer, and (3) another relatively rich fuel/air mixture adjacent the spark plug. During the compression stroke of the piston, the layered or stratified charge in the cylinder essentially maintains its stratified characteristics with reduced volume.

U.S. Pat. Nos. 4,413,593 and 4,453,502 disclose combustion control through prestratification wherein diluent gas is injected for knock control of high compression ratio or supercharged engines. Injecting the diluent gas allows the engine to operate on lower octane fuel than would be possible without the diluent charge. U.S. Pat. No. 4,105,009 discloses an anti-pollution head construction for an internal combustion engine. "Automotive Engine Alternatives", R. L. Evans, The University of British Columbia, Vancouver, B.C., Canada, Plenum Press, New York and London, 1987, discloses a stratified charge of gasoline with port injection.

U.S. Pat. No. 4,628,881 discloses a pressure controlled fuel injection system for internal combustion engines. Hydraulic control of metering of a fuel charge is accomplished by adjusting the peak injection pressure and minimum injection pressure of an accumulator type injector. The '881 patent discloses precisely timing when fuel injection is to occur by controlling the shutdown of a solenoid valve. The volume of an accumulator chamber and maximum and minimum pressures within the accumulator chamber are adjusted to control the quantity of fuel injected and to control the pressure at which the fuel is injected into the combustion chamber of the engine.

U.S. Pat. No. 4,610,236 discloses a fuel supply control for a dual induction type engine intake system. During an initial period of fuel injection through a secondary fuel injection valve, a portion of the fuel cannot be drawn into the combustion chamber immediately but may be deposited on a wall of a secondary intake passage to form a liquid film flow so that there is a possibility that a lean mixture is temporarily produced during such initial period.

U.S. Pat. No. 4,151,821 discloses an engine fuel supply system in which a fine stream of gasoline is sprayed through a nozzle against a hot inner surface of a bottom wall within an atomization chamber.

U.S. Pat. No. 3,140,701 discloses a fuel regulating intake valve. U.S. Pat. No. 3,068,086 discloses an equalizing system for gaseous fuel feed for internal combustion engines. The '086 patent teaches adjusting fuel/air mixtures by physically changing an internal diameter balance tube. U.S. Pat. No. 4,308,843 discloses a slow run apparatus for gaseous fueled internal combustion engines where gas flows under pressure from a primary section through a cover inlet and into an air cleaner assembly. U.S. Pat. No. 3,114,357 discloses a vaporizing device for liquid propane gas engines. U.S. Pat. No. 4,395,992 discloses a device for proportioning a gaseous fuel and air for combustion in an internal combustion engine.

U.S. Pat. Nos. 3,195,525 and 3,269,713 discloses governors for internal combustion engines, particularly speed governors and governors of the suction type. U.S. Pat. No. 4,610,267 discloses a fast-response solenoid valve.

SUMMARY OF THE INVENTION

It is one object of this invention to inject a mixture-enriching charge of fuel into an intake manifold and then into a cylinder or combustion chamber in a controlled manner so as to form a stratified charge within the combustion chamber.

It is another object of this invention to provide an apparatus having an upstream central fuel metering device to form a lean fuel/air mixture within an intake manifold and a downstream timed port injection device to enrich the lean fuel/air mixture in a controlled manner to form a stratified charge within a cylinder or combustion chamber.

It is still another object of this invention to provide a process and apparatus for admitting a gaseous fuel into an intake manifold, in a controlled manner to form a stratified charge within a cylinder or combustion chamber.

In one embodiment of this invention, the above objects of this invention are accomplished by a process for combusting fuel beginning with metering an initial portion of fuel and admitting air into an intake manifold to form a homogenous lean fuel/air mixture upstream of a cylinder intake port and one or more port fuel injectors. The homogenous lean fuel/air mixture is uniformly distributed into at least one cylinder during an intake phase of each corresponding cylinder. A remaining portion of the fuel is injected in a controlled manner during the intake phase so as to form a stratified charge within each cylinder and provide an enriched charge near an ignitor, such as a spark plug or the like. The richer fuel/air mixture of the stratified charge is ignited and in turn ignites the lean mixture within the cylinder. Combustion products are then exhausted from each cylinder.

In conventional internal combustion gasoline engines using indirect port injection, the fuel is injected in a liquid state. A majority of the fuel vaporizes on the back of the intake valve; some of the fuel vaporizes between the injector and the intake valve or other target area. Liquid fuels have certain disadvantages which include carrying dissolved and suspended substances to the intake valve or other point of vaporization. Such dissolved and suspended substances can result in extensive deposit buildup on the intake valve as well as at the injector nozzle tip.

Gaseous fuels eliminate many of the disadvantages inherent with gasoline or other liquid fuels. Gaseous fuels reduce the potential for deposit build-up. Injecting a gaseous fuel provides for better mixing and development of a homogeneous charge in the intake manifold, prior to the mixture entering the cylinder. It is an important aspect of one embodiment of this invention to have a homogeneous lean charge in the intake manifold when injecting the gaseous fuel at the intake port in a controlled manner during the intake phase to induce a stratified charge. Thus, it is preferred to use a gaseous fuel, such as natural gas, with the process and apparatus of this invention. However, it is not essential to use a gaseous fuel. Volatile liquid fuels, such as liquid propane, can be used if such volatile liquid fuels are vaporized at the point of injection, in the intake manifold.

The fuel, preferably gaseous, is injected into the intake manifold adjacent to the intake port during the mixture intake phase of the combustion chamber so as to form a stratified charge in the combustion chamber with an enriched mixture in the proximity of the ignitor to facilitate reliable ignition of the charge. The ignition of the enriched mixture will subsequently cause the complete reaction of the total charge. The fuel injection timing and rate must be variable to accommodate different operating conditions as well as different engine designs. In one embodiment, the preferred timing is to inject the predominant amounts of the fuel charge late in the intake cycle to position the enriched portion of the stratified charge in the proximity of the ignitor.

According to one embodiment of this invention, the fuel intake apparatus for timed port gaseous fuel injection includes an intake manifold having an upstream end and a downstream end. At least one control valve is in communication with the intake manifold. Each control or air throttle valve is positioned at or near the upstream end of the intake manifold. Each control valve proportionately limits the quantity of air admitted to mix with the fuel flow, preferably in response to one or more sensed signals, such as crankshaft position and speed, power settings, exhaust gas qualities, and the like.

In yet another embodiment of this invention, at least one gas valve is mounted within the downstream end of the intake manifold. Each gas valve is in communication with the intake manifold. Each gas valve is used to inject a gaseous fuel into the intake manifold near the intake port, at a predetermined time and in a predetermined amount. In one preferred embodiment according to this invention, a microprocessor or computer is used to emit a timed signal to which each port injector responds. The microprocessor or computer is preferably programmed to cause the port injector to inject a gas charge in a controlled manner during the intake stroke of the piston so as to form a stratified charge within the combustion chamber or cylinder. The microprocessor or computer can be programmed to cause or initiate injection of the gas charge in a continuous, modulated, intermittent and/or the like fashion. The microprocessor control system can also include control functions for other systems.

BRIEF DESCRIPTION OF THE DRAWING

The above mentioned and other features of this invention and the manner of obtaining them will become more apparent, and the invention itself will be best understood by reference to the following description of specific embodiments of the invention taken in conjunction with the accompanying drawings, wherein.

DESCRIPTION OF PREFERRED EMBODIMENTS

This invention accomplishes reduced exhaust emissions by operating an internal combustion engine with excess air for "lean-burn" combustion. The internal combustion engine can be a reciprocating engine, a rotary engine, or the like. It is possible to reduce the exhaust emissions by using a stratified charge to provide a richer or enriched fuel/air mixture near the ignition source. The terms "richer" and "enriched" are relative to a very lean fuel/air mixture throughout the remainder or lower portion of the cylinder or combustion chamber. In one control approach, by injecting a fuel into an intake manifold near an intake port in a controlled manner during an intake stroke, a stratified charge is formed.

Throughout the specification and claims, the term "cylinder" specifically refers to the combustion chamber of a reciprocating internal combustion engine. It is apparent that "cylinder" can be interchanged with "combustion chamber" of any internal combustion engine without detracting from the intent of this invention. It is also apparent that the internal combustion engine can comprise one or more combustion chambers. This invention is also applicable to any other engines operating with intermittent intake of the combustion charge, such as rotary engines.

Figure 1:
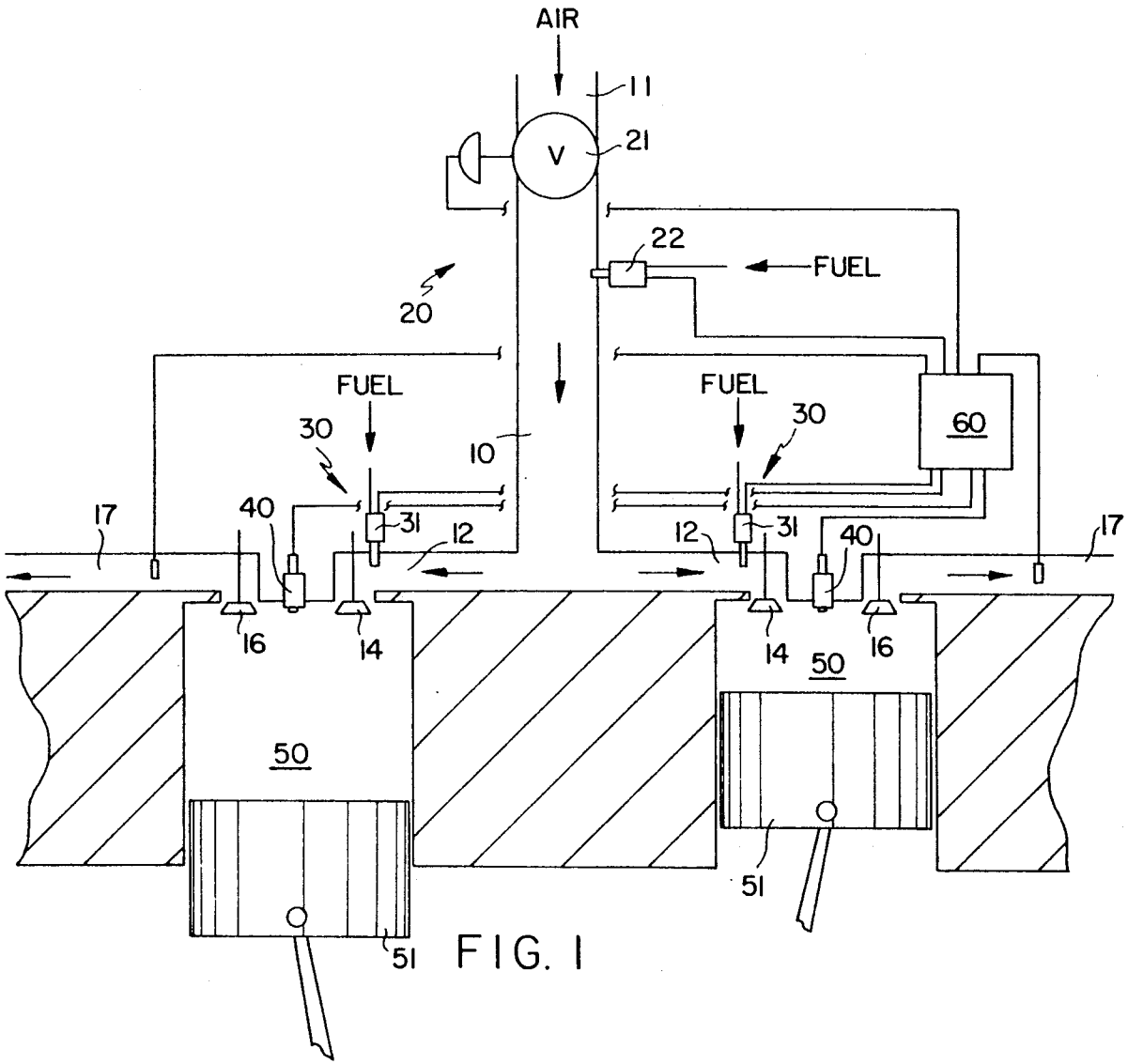
FIG. 1 shows a diagrammatic view of an apparatus having both lean fuel upstream injection and enriched fuel downstream injection, according to one embodiment of this invention.

According to one embodiment of this invention, as shown in FIG. 1, the lean fuel/air mixture is introduced into the cylinder throughout the intake phase and thus, the lean fuel/air mixture tends to occupy the lower portion of the cylinder. In a controlled manner during the intake phase, a fuel/air mixture is injected into the cylinder so as to stratify in an upper portion of the cylinder. An enriched portion of the fuel/air mixture remains in the upper region near the ignition source during the compression phase. Such enriched portion of the fuel/air mixture, within the upper portion of the cylinder, results in a reliably ignitable, more nearly stoichiometric fuel/air mixture at or near the ignition source, even though the average air-fuel ratio throughout the cylinder or other combustion chamber is relatively lean. A lean average fuel/air mixture results in lower combustion temperatures and thus reduced nitrogen oxides ($NO_x$) formation. Controlled excess air results in complete combustion of the fuel during later stages of combustion, thereby reducing unburned hydrocarbons and carbon monoxide (CO) to relatively low levels. It is important to control the excess air since too much excess air results in incomplete combustion and increased unburned hydrocarbons.

According to this invention, a lean fuel/air mixture reduces detonation or the tendency for the end gas to autoignite. The reduced tendency for detonation allows for increased compression ratios, and thereby increased power and engine efficiency. The high temperature and high pressure during the last part of combustion can cause the end gas mixture to autoignite in typical spark ignition engines. The enriched portion of the stratified charge of this invention also provides more consistent ignition and reduced cyclic irregularity. The lean fuel/air mixture yields reduced $NO_x$ emissions and the increased homogeneity provides for more uniform flame propagation, yielding more complete combustion by reducing the number of pockets of unreacted fuel. This results in reduced hydrocarbon emissions.

Referring to FIG. 1 which shows a diagrammatic view of an apparatus according to one embodiment of this invention, the process begins with introducing air into intake manifold 10. Such air intake is controlled by metering means 20. It is apparent that metering means 20 may comprise control valve 21, as shown, an orifice plate, or any other suitable control and/or flow restriction device known in the art. Metering means 20, partially shown as control valve 21, is in fluid communication with intake manifold 10. Metering means 20 can also include an upstream fuel injector 22.

An initial portion of fuel is injected into intake manifold 10 and combined with the air admitted through control valve 21 to form a lean fuel/air mixture within intake manifold 10, upstream of port injector means 30. Port injector means 30 is partially shown in FIG. 1 as gas valve 31. The lean fuel/air mixture is uniformly distributed through intake manifold 10 and into at least one combustion chamber 50 during an intake phase. As shown in FIG. 1, the process of this invention is particularly applicable to a reciprocating internal combustion engine, preferably a 4-cycle engine but also a 2-cycle engine. It is apparent that the process of this invention can also be applied to other internal combustion engines, such as a rotary engine or the like. A subsequent portion of fuel is injected into combustion chamber 50 in a controlled manner during the intake phase and thus forms a stratified charge near ignition means 40. The stratified charge remains near the top of or within an upper portion of combustion chamber 50 during the compression phase. The rich fuel or enriched mixture of the stratified charge is ignited by ignition means 40 and combusted within combustion chamber 50 and thus provides an ignition source for the remaining lean fuel/air mixture within combustion chamber 50. Combustion products are exhausted from combustion chamber 50 through exhaust valve 16 and exhaust manifold 17.

Figure 2:
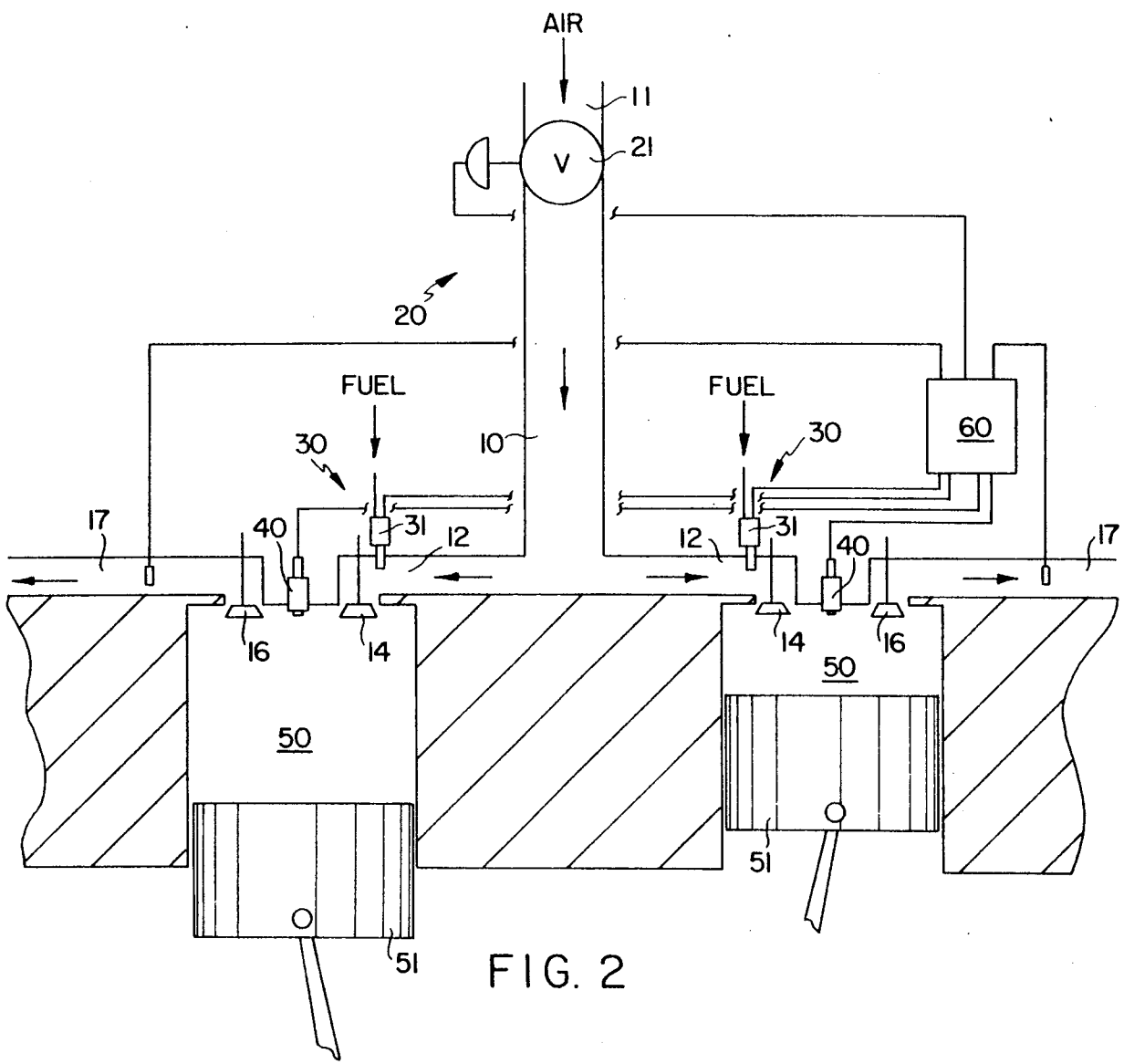
FIG. 2 shows a diagrammatic view of an apparatus having only gaseous fuel downstream injection, according to another embodiment of this invention.

FIG. 2 shows another preferred embodiment according to this invention, wherein timed port injection only occurs near a downstream end 12 of intake manifold 10. The fuel used in this particular embodiment comprises a gaseous fuel, preferably natural gas. Metering means 20 admits air into intake manifold 10. Relatively late during the intake phase, the gaseous fuel is injected into intake manifold 10. Microprocessor means 60 is used to control the timing and metering of gas valves 31. It is apparent that the gaseous fuel can be injected into intake manifold 10 at a constant or variable volumetric flowrate.

In another embodiment according to this invention, the fuel comprises a volatile liquid fuel. Volatile liquid fuels vaporize within intake manifold 10. Clean burning gaseous fuels, particularly natural gas and liquid propane, are preferred over relatively high boiling point volatile liquid fuels, such as gasoline, since the latter tend to carry dissolved and suspended substances to the intake valve or other point of vaporization within the engine. Such dissolved and suspended substances tend to form deposit build-up on intake valves 14 and within the injector nozzle tip. Additionally, a relatively low boiling point (gaseous) fuel, such as natural gas, provides for better fuel/air mixing, and therefore more uniform combustion and lower emissions in a lean-burn combustion system.

The flame speed of methane gas is low relative to gasoline. When using a stratified charge, the resultant time for homogenous mixing is reduced. The fuel/air mixture is ignited a greater number of crank angle degrees before piston 51 reaches the top dead center position of the compression phase, thus the stratified charge has less time to become thoroughly mixed. As piston 51 reaches top dead center of the compression phase, the volume of combustion chamber 50 is reduced and the reacting enriched portion of the stratified charge is mixed by turbulence from the induction process and by additional turbulence generated during compression, as piston 51 approaches the cylinder head. Such turbulent mixing will provide complete combustion.

Injecting a stratified charge is better adapted to lower speed engines. Lower speed engines have reduced turbulence which thus provides better separation between the lean fuel/air mixture and the enriched fuel portion of the stratified charge, during the compression phase. Thus the operating engine speed influences the effectiveness of an engine operating with an enriched stratified charge. An engine having a long stroke and operating at a relatively low rotational speed will prove more amenable than a shorter stroke engine having a relatively high rotational speed, due to a longer induction period and the ease of positioning the stratified charge in the incoming airflow.

Control means are used to time and meter the fuel into intake manifold 10. The subsequently introduced fuel portion forms the stratified charge. It is apparent that the control means can comprise microprocessor means 60 or other computer means which respond to input signals and emit output signals for controlling gas valve 31 or another suitable port injector, positioned upstream from intake valve 14. Intake valve 14 is in communication with intake manifold 10 and combustion chamber 50. Injection of the initial fuel portion into intake manifold 10 preferably occurs continuously. Metering means 20 restricts the airflow to provide partial control of the lean fuel/air mixture and metering means 20 can be controlled by microprocessor means 60.

According to this invention, it is not necessary to have a pre-chamber in which two independent mixtures are introduced into separate chambers, for forming a stratified charge. This invention preferably accommodates the use of gaseous fuels, such as natural gas, which have wider flammability limits, relative to the flammability limit of gasoline. Such gaseous fuels are also preferred over gasoline since gaseous fuels can provide extremely lean-burn characteristics and low $NO_x$ emissions. However, this invention does not have the design complexities of such prior art systems. Using gaseous fuels typically complicates the design and manufacture of fast-acting valves due to the higher volume of the fuel necessitating larger valve components. Low mass, fast-acting valves are preferred to provide precise metering and timing for forming the stratified charge. The fast-acting valves must also be capable of receiving a timed signal from microprocessor means 60 and quickly responding to such timed signal. By dividing the primary and enriching gas volume among multiple valves 22 and 31, as shown in FIG. 1, the individual high speed port injection valves have reduced size and lower mass components which are faster acting, more precisely controlled and thus more economical to manufacture. Such embodiment provides for introduction of a portion of the fuel via an upstream fuel injection valve which does not bear the fast-acting, intermittent, high flow volume requirements.

In a preferred embodiment according to this invention, the fuel intake apparatus for timed port and stratified charge fuel injection into combustion chamber 50 includes intake manifold 10 having upstream end 11 and downstream end 12, as shown in FIG. 1. Metering means 20, which may comprise control valve 21 and upstream injector 22, is preferably positioned near upstream end 11 and is in communication with intake manifold 10. Metering means 20 is used to control airflow and fuel injection into intake manifold 10 to form the lean fuel/air mixture within intake manifold 10. Port injector means 30, shown as gas valves 31 in FIG. 1, are positioned at or near downstream end 12. Port injector means 30 are in communication with intake manifold 10 for injecting fuel to enrich the lean mixture to form a stratified charge within combustion chamber 50. Control means are used for timed and metered injection of the fuel at a predetermined time and in a predetermined amount.

One preferred embodiment of this invention uses precisely metered and timed sequential fuel injection into an engine intake port through electronically controlled gas valves 31. Microprocessor means 60 controls gas valve 31 or other port injector means 30 by emitting a signal to an intermediate power source which supplies the power necessary to operate gas valve 31. Microprocessor means 60 receives several input signals and uses the input signals to modify the output signals which are used to adjust the timing and delivery of the initial and subsequent fuel portions.

In one embodiment according to this invention, microprocessor means 60 comprises a proportional lean-burn stoichiometry control feedback loop. Thus, port injector means 30 can have a greater variable fuel injection rate relative to upstream injector 22, at upstream end 11, which forms the lean fuel/air mixture. In such case, port injector means 30 has dominant control over the air-fuel ratio. If upstream injector 22 has dominant control over the air-fuel ratio, then port injector means 30 has a primary function of providing a relatively small and relatively constant volume fuel charge properly timed during the intake stroke for the purpose of providing an enriched portion of the charge for igniting the fuel/air mixture.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

We claim:

1. A process for combusting gaseous fuel in an internal combustion engine including the steps of:

(a) injecting the gaseous fuel into an intake manifold at a position upstream of and adjacent to an intake valve;

(b) precisely controlling an injection pressure and timing of the gaseous fuel injection into the intake manifold for injecting the gaseous fuel relatively late during an intake phase of a combustion cycle of the internal combustion engine to form a stratified charge in only an upper portion of a combustion chamber with an enriched portion of the stratified charge localized near ignition means within the combustion chamber;

(c) igniting and combusting the enriched stratified charge within the combustion chamber; and (d) exhausting combustion products from the combustion chamber.

2. A process according to claim 1 wherein the gaseous fuel comprises natural gas.

3. A process according to claim 1 wherein the gaseous fuel injection is precisely controlled by timing and starting intermittent injection of the gaseous fuel.

4. A process according to claim 3 wherein the timing and metering is accomplished with microprocessor means responding to input signals and emitting output signals for controlling gaseous fuel valve means positioned upstream of the intake valve.

5. A process according to claim 1 wherein the gaseous fuel is metered by at least one of intermittent, continuous and modulated injection into the intake manifold with metering means.

6. A process for combusting gaseous fuel in an internal combustion engine including the steps of:

(a) injecting an initial gaseous fuel portion into an intake manifold upstream of secondary gaseous fuel injection means to form a homogeneous lean gaseous fuel/air mixture in the intake manifold;

(b) introducing the lean gaseous fuel/air mixture into a combustion chamber of the internal combustion engine during an intake phase of a combustion cycle;

(c) port injecting a subsequent gaseous fuel portion into the intake manifold at a position upstream of and adjacent to an intake valve;

(d) precisely controlling an injection pressure and timing of the subsequent gaseous fuel portion injection into the intake manifold for injecting the subsequent gaseous fuel portion relatively late during the intake phase so as to form a stratified charge in only an upper portion of the combustion chamber with an enriched portion of the stratified charge localized near ignition means within the combustion chamber;

(e) igniting and combusting the stratified charge; and (f) exhausting formed combustion products from the combustion chamber.

7. A process according to claim 6 wherein the homogeneous lean fuel/air mixture is formed by controlling airflow and injection of the initial gaseous fuel portion into the intake manifold with control means.

8. A process according to claim 6 wherein the secondary gaseous fuel injection means further comprise at least one manifold port gaseous fuel injector for injecting the subsequent gaseous fuel portion adjacent to and upstream of the intake valve.

9. A process according to claim 6 wherein the gaseous fuel comprises natural gas.

10. A process according to claim 6 wherein the subsequent gaseous fuel portion injection is precisely controlled by timing and metering intermittent injection of the subsequent gaseous fuel portion into the intake manifold with control means.

11. A process according to claim 10 wherein the timing and metering is accomplished with microprocessor means responding to input signals and emitting output signals for controlling gaseous fuel valve means positioned upstream from the intake valve.

12. A process according to claim 6 wherein the initial gaseous fuel portion is precisely controlled by continuous injection into the intake manifold with metering means.

13. A fuel intake apparatus for timed port fuel injection and stratified charge formation within a combustion chamber, the fuel intake apparatus comprising:

an intake manifold having an upstream end and a downstream end, gaseous fuel metering means positioned near said upstream end and in communication with said intake manifold for introducing an initial gaseous fuel portion to form a lean gaseous fuel/air mixture within said intake manifold, timed port gaseous fuel injector means positioned near said downstream end adjacent to an upstream side of an intake valve and in communication with said intake manifold for port injecting a subsequent gaseous fuel portion and forming a stratified charge in only an upper portion of a combustion chamber with an enriched portion of said stratified charge localized near ignition means mounted within said combustion chamber; and control means for precisely timing and metering injection of gaseous fuel to form said lean gaseous fuel/air mixture and controlling an injection pressure and timing of said subsequent gaseous fuel portion injection into said intake manifold for injecting said subsequent gaseous fuel portion relatively late during an intake phase of a combustion cycle.

14. A fuel intake apparatus according to claim 13 wherein said metering means further comprise an air control valve and an upstream gaseous fuel injector in communication with said intake manifold.

15. A fuel intake apparatus according to claim 14 wherein said air control valve limits airflow to said intake manifold in response to a sensed signal.

16. A fuel intake apparatus according to claim 13 wherein said timed port gaseous injector means further comprise at least one gaseous fuel valve.

17. A fuel intake apparatus according to claim 13 wherein said control means further comprise computer means for emitting a signal to which said timed port gaseous fuel injector means respond.

18. A fuel intake apparatus according to claim 17 wherein said control means further controls said metering means to form said lean gaseous fuel/air mixture in said upstream end of said intake manifold.

19. A fuel intake apparatus for timed port and stratified charge injection of gaseous fuel into a combustion chamber, the fuel intake apparatus comprising:

an intake manifold having an upstream end and a downstream end, air metering means positioned near said upstream end and in communication with said intake manifold for admitting air into said intake manifold, timed port gaseous fuel valve means positioned near said downstream end adjacent to an upstream side of an intake valve and in communication with said intake manifold for port injecting the gaseous fuel into said intake manifold to form a stratified charge in only an upper portion of the combustion chamber with an enriched portion of said stratified charge localized near ignition means mounted within the combustion chamber; and control means for precisely controlling an ignition pressure and timing of the gaseous fuel injection into said intake manifold for injecting the gaseous fuel relatively late during an intake phase of a combustion cycle.

20. A fuel intake apparatus according to claim 19 wherein said air metering means further comprise an air control valve in communication with said intake manifold.

21. A fuel intake apparatus according to claim 19 wherein said air metering means limits airflow to said intake manifold in response to a sensed signal.

22. A fuel intake apparatus according to claim 19 wherein said timed port gaseous fuel valve means further comprise at least one gas valve mounted within said downstream end of said intake manifold.

23. A fuel intake apparatus according to claim 19 wherein said control means further comprise computer means for emitting a signal to which said timed port gas valve means respond.

24. A fuel intake apparatus according to claim 23 wherein said control means further controls said air metering means.

* * * * *